US005118152A

United States Patent [19]

Lin

[11] Patent Number: 5,118,152

[45] Date of Patent: Jun. 2, 1992

[54] INNER BEARING PLATE UNIT OF EASY ASSEMBLING FOR A LOCK

[76] Inventor: Jui C. Lin, No. 55-10, Been Chou Rd., KangShan, Kaohsiung Hsien, Taiwan

[21] Appl. No.: 670,938

[22] Filed: Mar. 18, 1991

[51] Int. Cl.[5] ..... E05B 15/02

[52] U.S. Cl. ..... 292/356; 292/357

[58] Field of Search ..... 292/357, 359, 356, 336.3

[56] References Cited

U.S. PATENT DOCUMENTS

| | | | |
|---|---|---|---|
| 3,228,218 | 1/1966 | Wilson | 292/356 |
| 3,677,593 | 7/1972 | Wahlberg | 292/357 |
| 4,789,191 | 12/1988 | Dennis | 292/357 |
| 4,869,083 | 9/1989 | DeMarseilles et al. | 292/357 |
| 4,921,289 | 5/1990 | Shen | 292/357 |
| 4,930,822 | 6/1990 | Shen | 292/357 |

FOREIGN PATENT DOCUMENTS

| | | | |
|---|---|---|---|
| 65211 | 12/1946 | Denmark | 292/357 |
| 1051158 | 2/1959 | Fed. Rep. of Germany | 292/356 |
| 701879 | 1/1954 | United Kingdom | 292/356 |

*Primary Examiner*—Eric K. Nicholson

*Attorney, Agent, or Firm*—Fleit, Jacobson, Cohn, Price, Holman & Stern

[57] ABSTRACT

An inner bearing plate unit of easy assembling for a lock comprising an inner bearing plate, an inner plate and a position plate, to be assembled with an outer bearing plate, said inner bearing plate and said inner plate being assembled together tightly sandwiching the position plate rotatable therein, said position plate having two opposite gourd-shaped holes for two connecting posts of the outer bearing plate to pass through, and the heads of screws mounted at the ends of said posts being able to be made to be positioned through the large diameter sections of said gourd-shaped holes and to stick in the two opposite holes in the inner bearing plate, thus assembling the inner bearing plate unit with the outer bearing plate.

4 Claims, 3 Drawing Sheets

INNER BEARING PLATE UNIT OF EASY ASSEMBLING FOR A LOCK

BACKGROUND OF THE INVENTION

This invention has a purpose to improve a U.S. patent application of the same title as this invention "Inner Bearing Plate Unit Of Easy Assembling For A Lock", Ser. No. 07/653,1264 which was filed by this same applicant on Feb. 11, 1991.

SUMMARY OF THE INVENTION

The inner bearing plate unit of easy assembling for a lock in the present invention comprises an inner bearing plate, an inner plate and a position plate rotatably sandwiched between the inner bearing plate and the inner plate as the main components.

The position plate has a central shaft hole to fit rotatably around a central tubular shaft in the inner plate, and two opposite gourd-shaped holes having small diameter sections and large diameter sections. The small diameter sections normally face to two opposite holes both in the inner bearing plate and in the inner plate when the position plate is in its original position elastically pulled by a replacing spring. The position plate also has a projection to extend and move rotatingly in a curved hole from its lower end to its upper end when the position plate is manually rotated to move away from its original position temporarily. The large diameter sections can face to the two opposite holes in the inner bearing plate and in the inner plate when the position plate is manually rotated with said projection moved to the upper end from the lower end of the curved hole, and then the heads of the screws in an outer bearing plate can be pushed to pass through said large diameter sections to stick in the two opposite holes in the inner bearing plate. Under the position, the position plate can be elastically rotated by the replacing spring, making the small diameter sections moved to fit around the threaded bodies of the screws to prevent the heads of the screws from retreating. Then a driver can be inserted through the two opposite holes in the inner bearing plate to screw tightly the screws on the position plate, finishing assembling this inner bearing plate unit with the outer bearing plate.

DETAILED DESCRIPTION OF THE INVENTION

Figure 1:
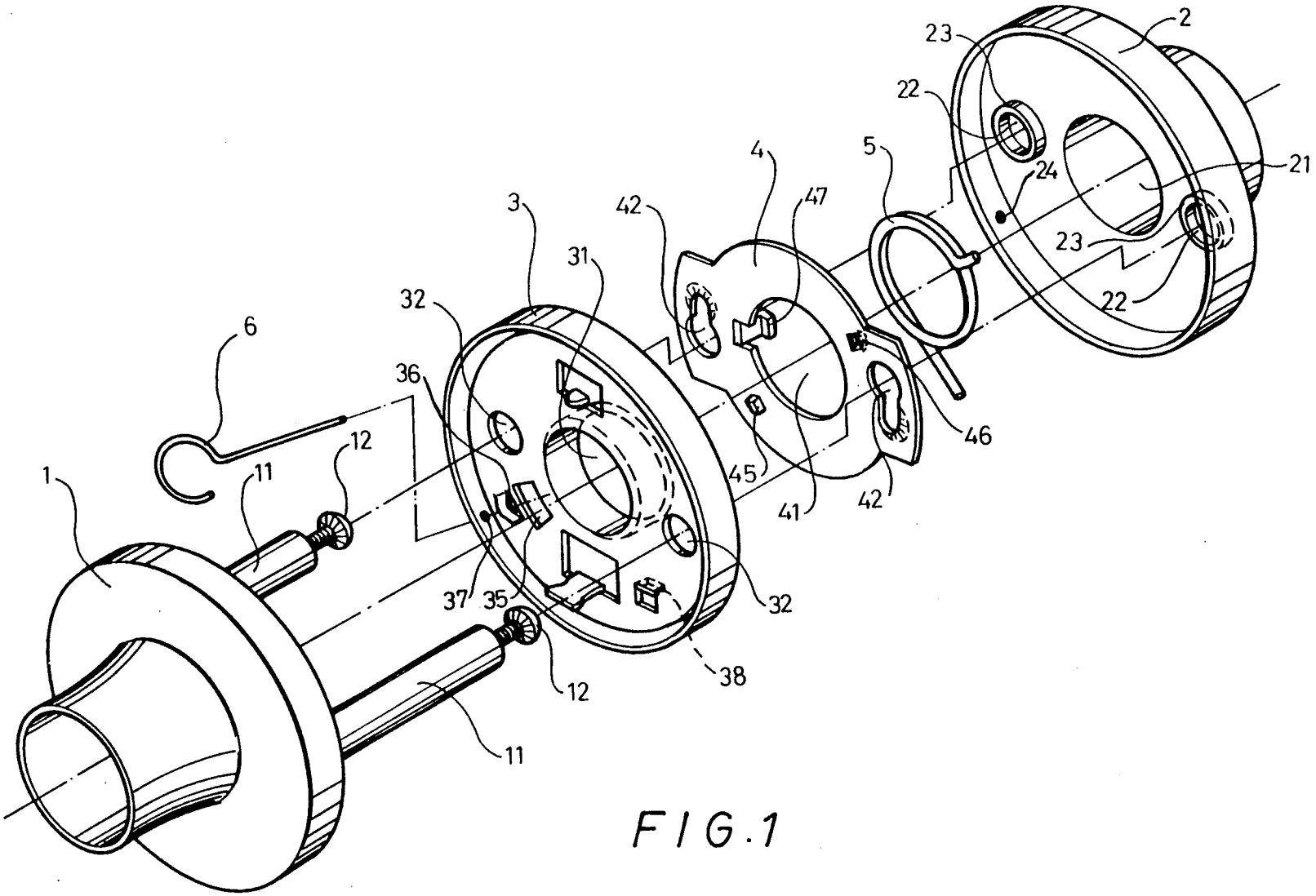
FIG. 1 is an exploded perspective view of the inner bearing plate unit of easy assembling for a lock in the present invention.
Figure 3:
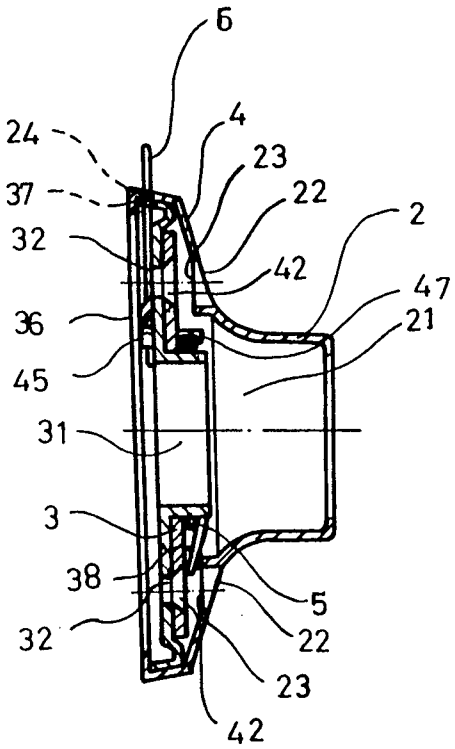
FIG. 3 is a cross-sectional view of line 3—3 in FIG. 3.
Figure 2:
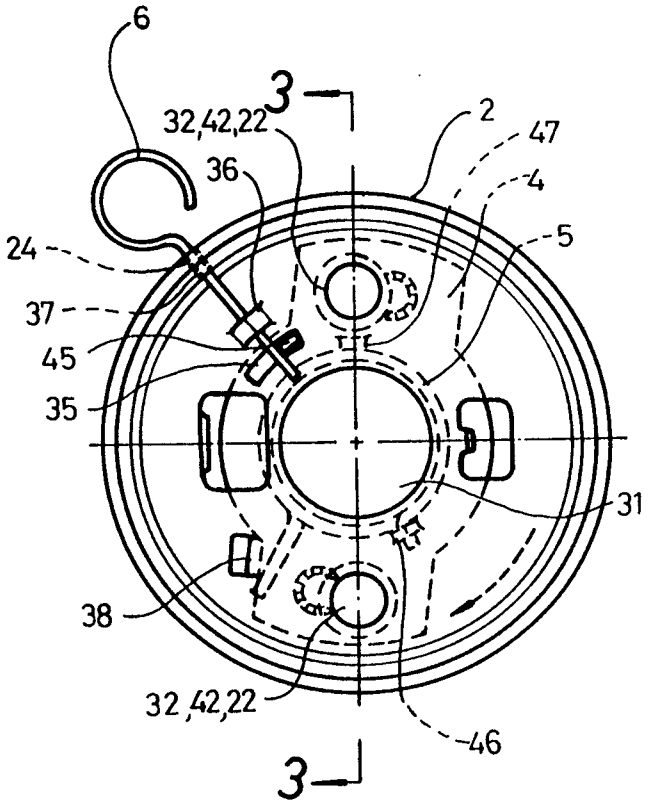
FIG. 2 is a bottom view of the inner bearing plate unit assembled together in the present invention.

The inner bearing plate unit of easy assembling for a lock in the present invention is to be assembled with an outer bearing plate 1 having two connecting posts 11, whose ends are in advance screwed with screws 12 projecting properly out of the post ends. The outer bearing plate 1 has almost the same structure as that used in a conventional lock.

The inner bearing plate unit comprises an inner bearing plate 2, an inner plate 3, a position plate 4 rotatably accommodated between the inner bearing plate 2 and the inner plate 3, and the both plates 2, 3 are assembled together immovable.

The inner bearing plate 2 has a central shaft opening 21 for a tubular shaft 31 in the inner plate 3 to fit therein, two opposite holes 22 surrounded by projecting inward round walls 23 such that the heads of the screws 12 can stick in the holes 22, and a small side hole 24 in its circumferential wall for the tip end of a location pin 6 to pass through.

The inner plate 3 has a central tubular shaft 31 fitting in the shaft hole 21 in the inner bearing plate 2, a small side hole 37 in its circumferential wall to face to the small side hole 24 in the inner bearing plate 2 for the locating pin 6 to pass through after both plates 2, 3 have been assembled together, two opposite holes 32 facing to the opposite holes 22 in the plate 2 and for the heads of the screws 12 to pass through after both plates 2, 3 have been assembled, a curved hole 35 for a projection 45 in the position plate 4 to pass through and to move therein such that the position plate 4 can be limited in its rotating angle, a swelled-up hole 36 beside the curved hole 35, a small side hole 37 in the circumferential projecting sideway wall in line with the hole 36 so that the locating pin 6 can pass through these holes 36, 37 to stop the projection 45 at the upper end of the curved hole 35 as shown in FIG. 1, and a sideway projection 38 for one end of a replacing spring 5 to hang at.

The position plate 4 has a central opening 41 to movably fit around the central tubular shaft 31 in the inner plate 3, two opposite gourd-shaped holes 42 whose large diameter sections can be passed through by the heads of the screws 12, and whose small diameter sections cannot be passed through by the heads of the screws 12, a projection 45 passing through the curved hole 35 in the inner plate 3 and possible to move therein and usually stopped at one end of the hole 35, a swelled-up hole 46 for the other end of the replacing spring 5 to stick in such that the position plate 4 can be moved by the spring 5. In addition, the plate 4 has a sideway projection 47 extending from the circumferential edge of the opening 41 near the left gourd-shaped hole 42 to limit the movement of the replacing spring 5.

A replacing spring 5 is shaped as a coil to fit around the outer surface of the tubular shaft 31, having two ends, one hanging at the sideway projection 38 in the inner plate 3 and the other sticking in the swelled-up hole 46 in the position plate 4 such that the position plate 4 always receives the elasticity of the replacing spring 5, letting the projection 45 normally stopping at the lower end of the curved hole 35 as shown in FIG. 1 and keeping the small diameter sections of the gourd-shaped holes 42 facing to the holes 32.

To finish assembling this unit in a factory, the position plate 4 has to be rotated to make the projection 45 to move to stop at the upper end from the lower end of the curved hole 35. And then the locating pin 6 has to be made its end tip passing through the side hole 24 in the inner bearing plate 2, the holes 37, 36 in the inner plate 3 and stopping the projecting 45 at the upper end of the curved hole 35. At the same time, the large diameter sections of the gourd-shaped holes 42 in the position plate 4 are facing to the opposite holes 32 in the inner plate 3 and to the opposite holes 22 in the inner bearing plate 2. Therefore, the heads of the screws 12 cna be pushed to pass through the gourd-shaped holes 42 to reach in the opposite holes 22.

Figure 5:
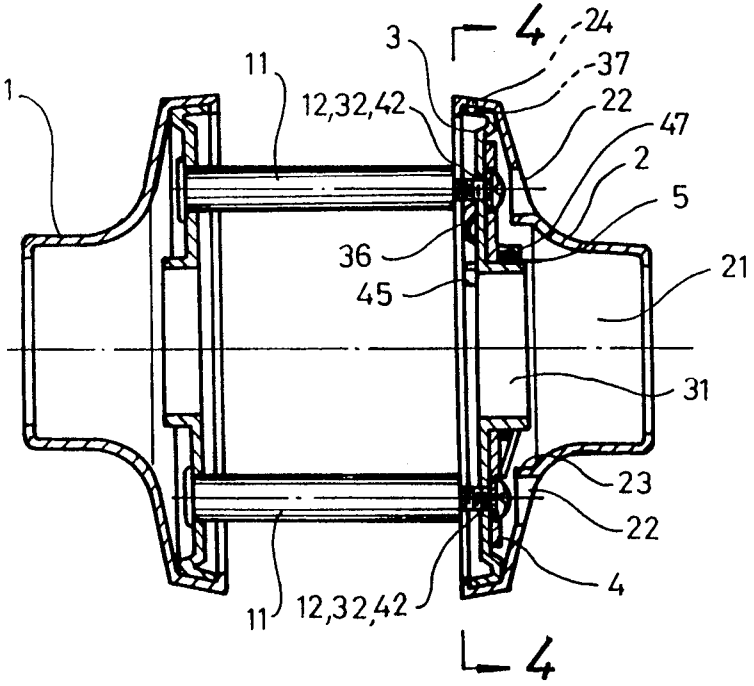
FIG. 5 is a cross-sectional view of the inner bearing plate unit assembled with the outer bearing plate.
Figure 4:
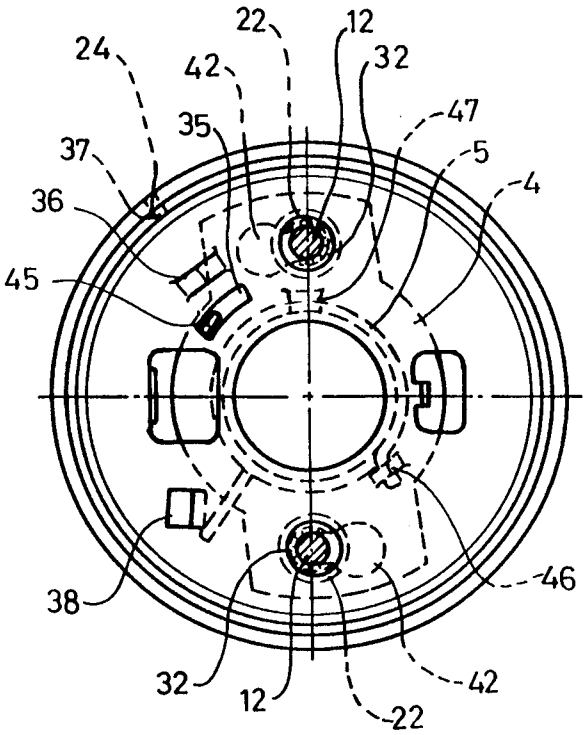
FIG. 4 is a cross-sectional view of line 4—4 in FIG. 5.

In accommodating lock as shown in FIG. 5, the heads of the screws 12 are to be inserted through the opposite holes 32 and the large diameter sections of the gourd-shaped holes 42 and then to stick in the opposite holes 22 in the inner bearing plate 2. Then the locating pin 6 is to be pulled outward, freeing the projection 45 such that the position plate 4 may be rotated by elasticity of the replacing spring 5, with the small diameter sections of the gourd-shaped holes 2 moving to face to the opposite holes 22 and 32 as shown in FIG. 4 and fitting around the threaded bodies of the screws such that a driver can be inserted through the holes 22 to screw the screws 12 tightly against the position plate 4, finishing assembling this inner bearing plate unit with the outer bearing plate in a lock on a door.

In assembling this inner bearing unit, it can be quickly done by screwing the screws 12 tightly. And to disassemble it, the projection 45 can be moved with the screws loosened to retreat, to a resultant easy operation.

What is claimed is:

1. An inner bearing plate unit for a lock to be combined with an outer bearing plate having two connecting posts with a screw screwing in their ends in advance, comprising;

an inner bearing plate having a central shaft hole for a tubular shaft in an inner plate to fit in, two opposite holes surrounded by projecting circumferential walls for the heads of the screws in the outer bearing plate to fit in;

an inner plate having a tubular shaft to fit in the shaft hole in the inner bearing plate, two opposite holes for the heads of the screws in the outer bearing plate to pass through and facing to the two opposite holes in the inner bearing plate after the inner plate has been assembled with the inner bearing plate;

a position plate to be rotatably sandwiched between the inner bearing plate and the inner plate, having a central shaft hole to fit around the tubular shaft in the inner plate such that the position plate can rotate sandwiched therein and two opposite gourd-shaped holes having large diameter sections for the heads of the screws to pass through and small diameter sections smaller than said large sections for the threaded bodies of the screws to fit therein; and said position plate able to be rotated to make the large diameter sections of the gourd-shaped holes in the position plate to face to the two opposite holes both in the inner plate and in the inner bearing plate such that the heads of the screws can pass through, said position plate then also able to be rotated to make the small diameter sections of the two opposite gourd-shaped holes face to the two opposite holes both in the inner plate and the inner bearing plate and let the threaded bodies of the screws to fit in said small diameter sections preventing the heads of the screws from retreating.

2. The inner bearing plate unit for a lock as claimed in claim 1, wherein the position plate is provided with a projection able to be stopped by the end of a locating pin passing through both a small side hole in the inner bearing plate and a small side hole in the inner plate such that the position plate can be kept at its original position.

3. The inner bearing plate unit for a lock as claimed in claim 1, wherein the position plate is provided with a projection extending through and possible to move in a curved hole in the inner plate such that said curved hole can restrict the rotating angle of the position plate.

4. The inner bearing plate unit of easy assembling for a lock as claimed in claim 1, wherein a replacing means is provided between the inner plate and the position plate to elastically rotate the position plate to return to its original position such that the large diameter sections of the two opposite gourd-shaped holes move away from and do not face to the two opposite holes in the inner plate after the position plate is released from a temporary movement away from its original position.

* * * * *